US007165572B2

(12) United States Patent
Hebblethwaite

(10) Patent No.: US 7,165,572 B2
(45) Date of Patent: Jan. 23, 2007

(54) FLUID STORAGE TANK WITH SPILL CONTAINMENT

(75) Inventor: Russ Hebblethwaite, Union Bay (CA)

(73) Assignee: Enviro Vault Ltd., Union Bay (CA)

( * ) Notice: Subject to any disclaimer, the term of this patent is extended or adjusted under 35 U.S.C. 154(b) by 479 days.

(21) Appl. No.: 10/708,921

(22) Filed: Mar. 31, 2004

(65) Prior Publication Data

US 2005/0224500 A1 Oct. 13, 2005

(51) Int. Cl.
*B67D 5/62* (2006.01)

(52) U.S. Cl. ..... 137/312; 141/88

(58) Field of Classification Search ..... 137/312; 141/86, 88, 94; 220/567, 565, 571
See application file for complete search history.

(56) References Cited

U.S. PATENT DOCUMENTS 5,134,683 A * 7/1992 Powell ..... 137/312
5,186,577 A * 2/1993 Reicin et al. ..... 137/312
5,960,826 A 10/1999 Hebblethwaite ..... 136/551
6,516,754 B2 2/2003 Chadwick ..... 122/19.1
6,679,400 B1 * 1/2004 Goodman ..... 137/312

* cited by examiner

*Primary Examiner*—Kevin Lee
(74) *Attorney, Agent, or Firm*—Bennett Jones LLP

(57) ABSTRACT

The present invention provides for above-ground fluid storage tanks having an internal spill containment system. In particular, the present invention is directed to an oil storage tank with a valve and spill containment system, where the valves are kept in a warm and dry environment, protected from the elements, but which still readily accessible, and, further, where spillage from the valves is contained. Further, the containment system disclosed allows for convenient retrofit into existing tanks as well as new tank manufacture. The invention discloses a containment chamber that will fit into existing manways and which is bolted to the tank using the existing bolt pattern that held the manway door on.

12 Claims, 3 Drawing Sheets

FLUID STORAGE TANK WITH SPILL CONTAINMENT

BACKGROUND OF INVENTION

The invention relates to an above-ground fluid storage tank, and in particular to a fluid storage tank, with a valve and spill containment system.

When gas is extracted from the ground, it is often extracted along with volumes of water mixed with particulate solids such as sand and carbon. The gas is separated from the mixture and the water mixed with solids is diverted to a storage tank for temporary storage in the field.

Similarly, when crude oil is pumped out of the ground, often it is pumped along with a mixture of sand and water. This mixture is pumped directly to above-ground oil storage tanks for temporary storage in the field. Because the proportion of water to oil varies from oil well to oil well, these tanks must have valves at different levels on the tank from which oil or water is drawn off.

Although these fluid storage tanks may vary in size from 100 barrel capacity to over 100,000 barrel capacity, a common size tank is in the 750 to 1000 barrel range. Such a tank is normally cylindrical, has a radius of less than 8 feet and stands approximately 25 to 32 feet high.

Within these tanks, the stored fluid settles and the solids sink to the bottom. With oil storage tanks, a series of valves and taps are provided on the exterior of the tank to draw off or sample the fluid at different heights within the tank. A common arrangement is to provide a loading spout and valve at about the 12 foot mark, a series of sample taps at the three foot, six foot, nine foot and 12 foot marks and an outlet valve and nozzle at about the three foot mark, alternatively a system of risers may be used to extract fluid from different levels of the tank. With water storage tanks used in gas production, it is common to simply have a single drainage valve and tap positioned towards the base of the tank. Normally, fluid is drawn out of the tanks through the outlet valve by a vacuum truck which applies a vacuum to the tank through a hose.

These external valves and taps, and especially the outlet valve and nozzle at the three foot mark, are subject to the elements. Abrasive dirt and dust may cause premature wear or seizure of the valve. It may corrode. In colder weather, the valve may freeze-up due to moisture despite the fact these tanks are usually heated from within by a burner tube. When the valve does freeze-up either it is forced open or steamer trucks must be called in to thaw the frozen valve and to allow the oil or water in the tank to be withdrawn. Often the valve cracks or breaks when it is forced open. Replacing the valve is an expensive and time-consuming operation as the tank must be emptied. Calling a steamer truck is also expensive because of the down-time while the vacuum truck stands by idly waiting for the services of the steamer truck.

Above-ground fluid storage tanks also create risks of environmental damage. There is always spillage from the three foot outlet valve or the loading spout whenever a hose is connected or disconnected. Also, these tanks are known to overflow if they are not emptied on a regular basis. The overflow occurs through vents and thief hatches normally provided at the top of the tank and the fluid runs down the exterior of the tank onto the ground.

One cumbersome prior art solution to the freeze-up problem is to wrap these valves in insulation, to prevent freezing. However, this insulation may come loose and further, deteriorates quickly as it becomes saturated with oil and salt water. Also, insulating the valve does not always ensure the valve does not freeze in very cold weather.

Another prior art solution is to build a cabinet around the valve on the exterior of the tank. This cabinet does not have a floor; it is open to the ground. However, this solution also does not prevent freezing of the valve in very cold weather and provides only limited containment of spills and leakage from the valve in that the ground is still exposed.

In U.S. Pat. No. 5,960,826, a spill containment chamber which is enclosed within the tank is disclosed. This chamber took the form of a cabinet which was welded to the interior surface of the tank. An opening into the cabinet was cut into the tank wall to provide access to the valves contained within the cabinet. This solution is somewhat awkward when retrofitting the internal chamber into existing tanks. This solution is also not well adapted to double-walled tanks, which are desired or required in many situations. In addition, the insertion of this type of chamber into tanks with a coated interior often results in a breach of the integrity of the coat necessitating a recoating process which is both time consuming and expensive.

There is therefore a need in the industry for a fluid storage tank with a valve and spill containment system, where the valves are kept in a warm and dry environment, protected from the elements, but still readily accessible, and, further, where spillage from the valves is contained. It would be preferred if the containment system allowed for convenient retrofit into existing tanks as well as new tank manufacture, provided that during retrofit insertion the integrity of any pre-existing coating should be maintained.

SUMMARY OF INVENTION

The present invention relates to a fluid storage tank having an interior volume and a floor and having an internal spill containment chamber. In one embodiment the chamber comprises: (a) a containment wall which completely separates the chamber from the tank interior volume; (b) an attachment flange disposed about a periphery of the chamber for attachment to the tank; (c) at least one fluid outlet for fluid communication with the tank interior volume; (d) valve means associated with the fluid outlet for controlling fluid flow through the fluid outlet; and (e) low-friction support means disposed between the tank floor and the containment chamber.

In another embodiment the chamber also has a heater. In one embodiment the low friction support means comprise at least one plastic insert, and in a further embodiment the low friction support means comprises a high-density polyethylene plastic.

In one embodiment the containment chamber and attachment flange is shaped to fit into an existing manway opening. The attachment flange may be bolted to an exterior surface of the tank using pre-existing or newly created bolt holes.

In a further embodiment, the fluid storage tank further comprises a recovery means within the chamber for recovering fluids from the chamber. The recovery means may be secured to the fluid outlet and in one embodiment, the recovery means comprises recovery valve means for controlling fluid flow through the fluid outlet and a recovery pipe having a first end and a second end where the recovery pipe is attached to the recovery valve means and the recovery pipe extends into the chamber. In further embodiments, the recovery pipe may extend vertically or horizontally into the chamber. In a further embodiment, the recovery valve means is secured to the fluid outlet in a position located between the end of the fluid outlet protruding into the chamber and the fluid outlet valve means such that when suction is applied to the end of the fluid outlet and the recovery valve means is open and the fluid outlet valve means is closed, fluid in the chamber may be recovered.

The present invention is also directed to a method of fitting a fluid storage tank with a spill containment chamber, wherein said tank defines a pre-existing or newly created manway opening, the method comprising the steps of: (a) providing a containment chamber having an attachment flange which is larger than the manway opening; (b) sliding the chamber into the tank through the manway opening using a low-friction support device disposed between the tank floor and the containment chamber; (c) bolting the attachment flange to the tank using pre-existing or newly created bolt holes.

BRIEF DESCRIPTION OF DRAWINGS

The invention will now be described by way of an exemplary embodiment with reference to the accompanying simplified, diagrammatic, not-to-scale drawings. In the drawings.

DETAILED DESCRIPTION

The present invention provides for fluid storage tank having an internal spill containment system. In particular, the present invention is directed at above-ground fluid storage tanks that can be used for temporary storage of fluids produced during oil and gas production. When describing the present invention, all terms not defined herein have their common art-recognized meanings.

Figure 1:
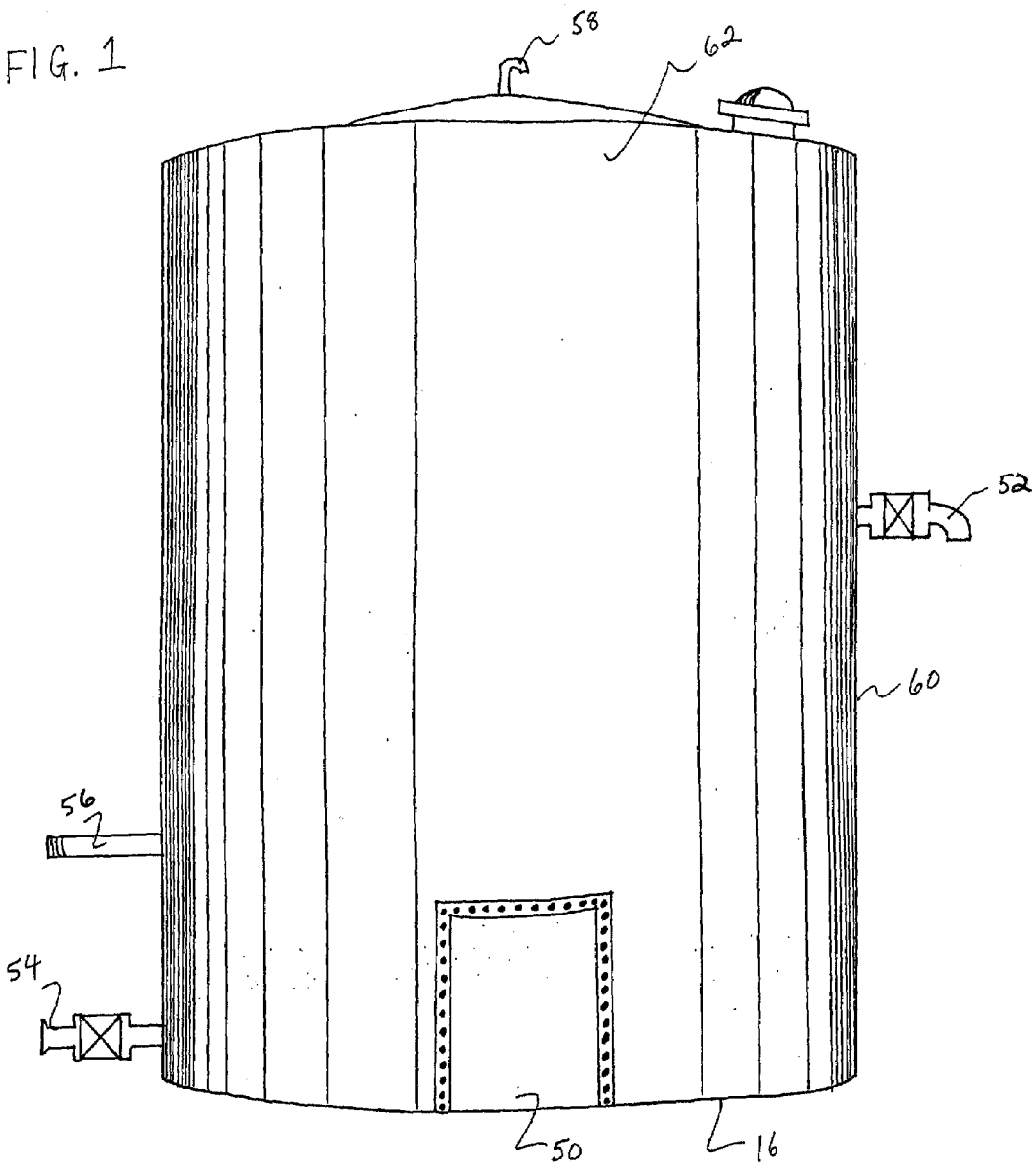
FIG. 1 is a pictorial view of the exterior of an oil storage tank.

Standard above-ground fluid storage tanks, including double-walled or lined tanks, are typically manufactured with a manway opening at or near ground level, which permits entry of service personnel into the interior of the tank. FIG. 1 depicts a standard above ground fluid storage tank having a manway (50), a loading spout (52), a waste outlet (54), an inlet pipe (56), a vent (58), an exterior surface (60), an interior volume (62) and a floor (16). The exact dimensions and position of the manway opening may vary from manufacturer to manufacturer but they all are sized to permit an average sized person to pass through and are relatively near ground level, if not positioned right at ground level. The manway openings are closed with a secure door which is bolted to the tank around its periphery in a secure leak-proof manner.

The present invention provides for a spill containment chamber which may be inserted into a pre-existing or newly cut manway opening from the exterior and bolted to the tank.

Figure 2:
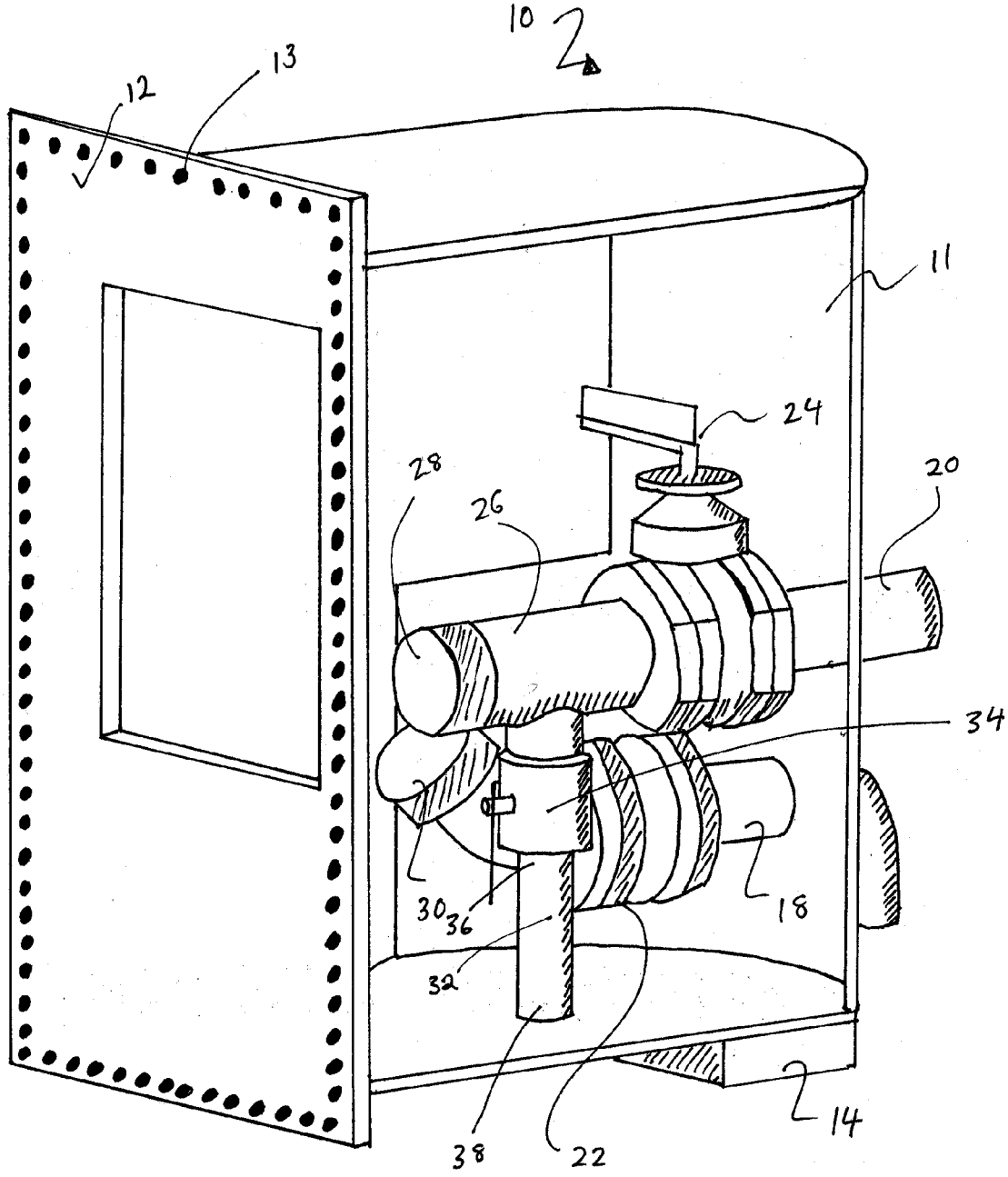
FIG. 2 is a cross-sectional side view of one embodiment of the chamber.
Figure 3:
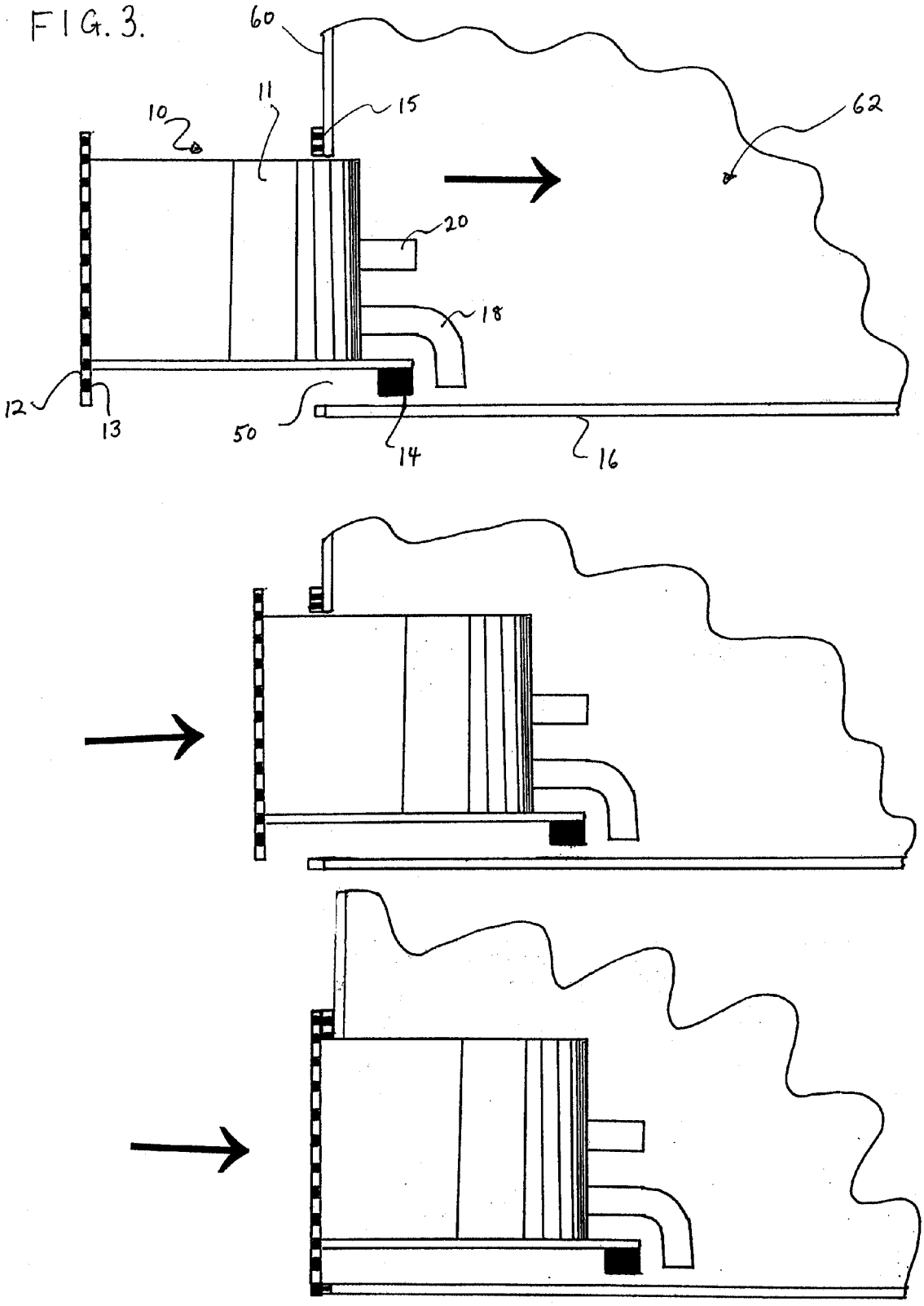
FIG. 3 is a diagrammatic depiction of insertion of the chamber into a tank.

As shown in FIG. 2, the chamber (10) has an attachment flange (12) disposed about the periphery of the chamber, as depicted in FIG. 1. The flange (12) defines a bolt pattern which matches a bolt pattern around the periphery of the intended opening. As shown in FIG. 3, the periphery of an existing manway opening commonly has a protruding flange (15) with a preexisting bolt hole pattern. A suitable gasket material is placed between the attachment flange (12) and the tank, to ensure a fluid-tight seal. The gasket may be any suitable material such as a plastic or rubber material, which are well-known in the art. The chamber (10) and flange (12) may be shaped to fit into an existing manway, or alternatively, a new manway can be cut into the side of the tank to accommodate the chamber (10) and flange (12). The chamber (10) has a containment wall (11) that completely separates the interior of the chamber (10) from the interior volume of the tank (62).

Sleepers (14) are provided between the floor (14) of the chamber (10) and the tank floor (16). During installation of the chamber (10) the sleepers (14) may contact the tank floor (16), however once the chamber (10) is bolted into place, the sleepers (14) are elevated from the tank floor (16) as shown in FIG. 3. The sleepers (14) have two intended functions. First, the sleeper (14) acts as a support means during installation of the chamber (10), or at some point in the future. If solids settle on top of the chamber (10) the additional weight exerts a gravitational pull on the tank which can cause the tank walls to distort or settle in the area around the attachment point of the chamber (10) to the tank. If this occurs, and if no support is provided, the weight of the chamber may cause the attachment flange (12) to separate from the tank, or may cause the tank to buckle around the attachment flange. If the chamber sags or lowers, the sleeper (14) will contact the tank floor (16), supporting the weight of the chamber (10) thereby relieving stress on the tank walls. Second, the sleepers (14) may facilitate installation of the chamber (10) by providing a low-friction buffer between the chamber (10) and the tank floor (16). This is important with respect to coated tanks because the use of the sleepers (14) prevents rupture or scraping of the coating on the tank floor (16) by the chamber (10) during installation. The sleepers (14) may be a non-resilient material such as a hard plastic, or more specifically they may be made from high-density polyethylene plastic, or such other suitable material as is used in the art. The sleepers may be made of any material which may support the weight of the chamber (10) and prevent direct contact between the chamber (10) and tank floor (16) upon installation. The number of sleepers and the height of the sleepers can be varied as required.

The chamber (10) is typically constructed from steel but it may be constructed from such other suitable materials as fiberglass or plastic.

In one embodiment a heater (not shown) of any type may be mounted in the chamber (10) to prevent freezing of the components located in the chamber (10), to reduce heat loss from the interior of the tank through the chamber walls, and to heat the contents of the tank. Suitable catalytic heaters are well-known in the art.

The embodiment of the present invention depicted in FIG. 2 has two fluid outlets, a tank drain outlet pipe (18) and a draw off outlet pipe (20). There is an outlet valve (22) (the "drain valve") attached to the tank drain outlet pipe (18). As shown in FIG. 2, the outside end of the drain valve is capped with a bull plug (30) when not in use, alternatively a threaded camlock and cap may be used. The drain valve (22) is attached to the tank drain outlet pipe (18) using studs (not shown) or by such other suitable means as are commonly utilized in the art. In FIG. 2 there is only one draw off pipe outlet pipe (20) depicted, however it should be understood that a number of draw off pipes may be incorporated into the present invention to facilitate draw off from varying fluid levels within the tank. Similarly, it should also be understood that the chamber (10) may only have one fluid outlet to facilitate draining of the tank.

There is an outlet valve (24) (the "draw valve") attached to the draw off outlet pipe (20). As depicted in FIG. 2, the draw valve (24) is attached to a tee fitting (26). The outside end of the tee fitting (26) is capped by a bull plug (28), alternatively a threaded camlock and cap may be used. The draw valve (24) is attached to the draw off outlet pipe (20) using studs (not shown) or by such other suitable means as are commonly utilized by one skilled in the art. A three to four inch gate valve, as is commonly known in the art, is a suitable type of valve for the draw valve (24) and the drain valve (22), however other equally suitable sizes or types of valve may be used.

As shown in FIG. 2, in one embodiment, a recovery pipe (32) and recovery valve (34) are attached to the tee fitting (26) and the recovery pipe (32) extends downwardly into the chamber (10). The recovery valve (34) may be a ball valve that attaches to the bottom end of the tee fitting (26), however such suggestion is not intended to be limiting of the invention claimed herein. The first end of the recovery pipe (36) attaches to the recovery valve (34). The second end of the recovery pipe (38) should have a minimum clearance of about one and a half inches from the lower surface of the chamber to allow unimpeded fluid flow into the recovery pipe (32). In another embodiment (not shown) the recovery pipe (32) may extend horizontally into the chamber (10).

When fluid is drawn from the tank drain outlet pipe (18), the bull plug is removed (30) and a female camlock fitting is attached (not shown). Then a conventional hose and male cam lock fitting may be secured prior to opening the drain valve (22). The same process is followed for extracting fluid from the draw off outlet pipe (20). When spilled fluid has accumulated in the chamber (10), it may be recovered by a vacuum truck by closing the draw valve (24) and opening the recovery valve (34). Spilled fluid is then drawn out of the chamber (10) by the vacuum truck.

It should be understood that the chamber (10) may also have valves and outlets configured in a like manner to that described in Applicant's co-owned U.S. Pat. No. 5,960,826, the contents of which are incorporated herein by reference.

FIG. 3 illustrates the process for installing the chamber into a tank. First the tank must be drained and the manway coverplate and associated hardware must be removed. Alternatively, after draining the tank, a new manway can be cut into the side of the tank. The area on the exterior surface of the tank (60) that will contact the flange (12) and associated gasket material can be cleaned to maximize the fluid tight seal formed by those components. If the manway (50) is flush with the floor of the tank (16) then the chamber may be pushed into the tank as shown in FIG. 3. The sleepers (14) provide a low friction buffer to prevent damage to the tank floor (16) as the chamber (10) slides into the tank. Additional lubricant such as clear grease may also be used to further reduce friction between the sleepers (14) and the tank floor (16). If the manway (50) is not flush with the tank floor, then the chamber (10) will be elevated during insertion to permit clearance of the sleepers (14) over the lip between the bottom of the manway (50) and the tank floor (16). Once the sleepers (14) have cleared the lip, the chamber (10) may be lowered and pushed into the tank until the flange (12) and gasket contact the exterior surface of the tank (60). At this point the bolt holes (13) in the flange are aligned with the existing bolt pattern on the exterior surface of the tank (60) or the flange (15) around the manway opening and the bolts removed during the coverplate removal process are replaced, or alternatively, if a new manway has been cut then new aligned bolt holes will be created in the flange (12) and the exterior surface of the tank (60) and new bolts will be inserted. The bolts are tightened until a fluid tight seal has been attained.

As will be apparent to those skilled in the art, various modifications, adaptations and variations of the foregoing specific disclosure can be made without departing from the scope of the invention claimed herein. The various features and elements of the described invention may be combined in a manner different from the combinations described or claimed herein, without departing from the scope of the invention.

The invention claimed is:

1. A fluid storage tank having an interior volume and a floor and having an internal spill containment chamber, said chamber comprising:

(a) a containment wall which completely separates the chamber from the tank interior volume;

(b) an attachment flange disposed about a periphery of the chamber for attachment to the tank;

(c) at least one fluid outlet for fluid communication with the tank interior volume;

(d) valve means associated with the fluid outlet for controlling fluid flow through the fluid outlet; and (e) low-friction support means disposed between the tank floor and the containment chamber.

2. The tank of claim 1 wherein said chamber further comprises a heater.

3. The tank of claim 1 or 2 wherein the low friction support means comprises at least one plastic insert.

4. The tank of claim 3 wherein the low-friction support means comprises a high-density polyethylene plastic.

5. The tank of claim 1 wherein the containment chamber and attachment flange is shaped to fit into an existing manway opening.

6. The tank of claim 1 or 5 wherein the attachment flange is bolted to an exterior surface of the tank using pre-existing or newly created bolt holes.

7. The fluid storage tank of claim 1 further comprising recovery means within the chamber for recovering fluids from the chamber.

8. The fluid storage tank of claim 7 wherein the recovery means is secured to the fluid outlet.

9. The fluid storage tank of claim 8 wherein the recovery means comprises recovery valve means for controlling fluid flow through the fluid outlet and a recovery pipe having a first end and a second end where the recovery pipe is attached to the recovery valve means and the recovery pipe extends into the chamber.

10. The fluid storage tank of claim 9 wherein the recovery pipe can extend either vertically or horizontally into the chamber.

11. The fluid storage tank of claim 9 wherein the recovery valve means is secured to the fluid outlet in a position located between the end of the fluid outlet protruding into the chamber and the fluid outlet valve means such that when suction is applied to the end of the fluid outlet and the recovery valve means is open and the fluid outlet valve means is closed, fluid in the chamber may be recovered.

12. A method of fitting a fluid storage tank with a spill containment chamber, wherein said tank defines a pre-existing or newly created manway opening, said method comprising the steps of:

(a) providing a containment chamber having an attachment flange which is larger than the manway opening;

(b) sliding the chamber into the tank through the manway opening using a low-friction support device disposed between the tank floor and the containment chamber;

(c) bolting the attachment flange to the tank using pre-existing or newly created bolt holes.

* * * * *